US005739097A

United States Patent [19]

Bauer et al.

[11] Patent Number: 5,739,097

[45] Date of Patent: Apr. 14, 1998

[54] PROCESS FOR THE PRODUCTION OF SURFACTANT GRANULES

[75] Inventors: Volker Bauer, Duesseldorf; Jochen Jacobs, Wuppertal; Bernhard Gutsche, Hilden; Thomas Lueder, Langenfeld; Christoph Breucker; Guenter Panthel, both of Haan, all of Germany

[73] Assignee: Henkel Kommanditgesellschaft auf Aktien

[21] Appl. No.: 763,923

[22] Filed: Dec. 12, 1996

Related U.S. Application Data

[63] Continuation of Ser. No. 501,010, filed as PCT/EP94/00301 Feb. 2, 1994, abandoned.

[30] Foreign Application Priority Data

Feb. 11, 1993 [DE] Germany ..... 43 04 062.4

[51] Int. Cl.[6] ..... C11D 11/00

[52] U.S. Cl. ..... 510/446; 510/351; 510/357; 510/444; 510/457; 510/458; 510/483; 510/491; 510/495; 510/535; 510/536; 23/313 FB; 159/48.1; 562/45; 562/97

[58] Field of Search ..... 510/446, 351, 510/357, 444, 457, 458, 483, 491, 495, 535, 536; 23/313 FB; 159/48.1; 562/45, 97

[56] References Cited

U.S. PATENT DOCUMENTS

| | | | |
|---|---|---|---|
| 4,894,117 | 1/1990 | Bianchi et al. | 159/49 |
| 4,919,847 | 4/1990 | Barletta et al. | 252/558 |
| 5,189,207 | 2/1993 | Blasey et al. | 562/97 |

FOREIGN PATENT DOCUMENTS

| | | |
|---|---|---|
| 0083122 | 7/1983 | European Pat. Off. . |
| 0319819 | 6/1989 | European Pat. Off. . |
| 0402111 | 12/1990 | European Pat. Off. . |
| 0402112 | 12/1990 | European Pat. Off. . |
| 0403148 | 12/1990 | European Pat. Off. . |
| 0451894 | 10/1991 | European Pat. Off. . |
| 4127323 | 7/1991 | Germany . |
| 9304154 | 8/1990 | WIPO . |
| 9304162 | 3/1993 | WIPO . |

*Primary Examiner*—Douglas J. McGinty
*Assistant Examiner*—Lorna M. Douyon
*Attorney, Agent, or Firm*—Ernest G. Szoke; Wayne C. Jaeschke; Real J. Grandmaison

[57] ABSTRACT

In the production of granules containing anionic surfactants and having a bulk density above 450 g/l by granulation of a surfactant preparation containing a non-surface-active liquid component, the water demand and hence the energy demand for evaporating the water can be reduced if the anionic surfactant in its acid form or a mixture containing one or more anionic surfactants in their acid form and an aqueous alkaline solution are separately treated with a gaseous medium, subsequently sprayed in substantially stoichiometric quantities into the granulation and drying zone either separately or together under a high propellant gas pressure and then granulated and, at the same time, dried, optionally with addition of one or more inorganic or organic solids.

15 Claims, No Drawings

PROCESS FOR THE PRODUCTION OF SURFACTANT GRANULES

This application is a continuation of application Ser. No. 08/501,010 filed on Aug. 11, 1995, now abandoned, which is a 371 PCT/EP94/00301 filed Feb. 2, 1994.

BACKGROUND OF THE INVENTION

1. Field of the Invention

This invention relates to a process for converting liquid to paste-like preparations of washing- and cleaning-active surfactant compounds into storable dust-free granules of high bulk density.

2. Discussion of Related Art

Surfactant granules can be produced, for example, by conventional drying of surfactant-containing solutions and pastes, more particularly in a spray drying tower. European patent application EP 319 819, for example, describes a process for the production of surfactant granules by spray drying, in which a sulfonic acid and a highly concentrated aqueous sodium hydroxide solution are separately treated with a gaseous medium, subsequently combined in stoichiometric quantities, neutralized in a multicomponent nozzle and sprayed under high propellant gas pressure in a spray drying tower. The products obtained are solid or paste-like, solid products generally being relatively dusty and having a comparatively high water content and a low bulk density.

An alternative to the spray drying of surfactant pastes is granulation. Thus, European patent application EP 403 148 describes a process for the production of fatty alcohol sulfate granules which are dispersible in cold water. In this process, a highly concentrated aqueous fatty alcohol sulfate paste containing less than 14% by weight of water and less than 20% by weight of other additives is mechanically treated at temperatures of 10° to 45° C. until granules are formed. Although this process gives fatty alcohol sulfate granules which are dispersed at washing temperatures of only 4° to 30° C., the process temperature to be maintained and the relatively low maximum water content of the surfactant paste represent critical process parameters. In addition, there is no mention of the bulk densities of the granules obtained by this process.

European patent application EP 402 112 describes a process for the production of fatty alcohol sulfate and/or alkyl benzenesulfonate granules in which neutralization of the anionic surfactants in acid form to give a paste containing at most 12% by weight water with addition of auxiliaries, such as polyethylene glycols, ethoxylated alcohols or alkylphenols having a melting point above 48° C. and granulation are carried out in a high-speed mixer. The quantity of water to be maintained is again a critical process parameter. In addition, there is no mention of the bulk densities of the surfactant granules obtained by this process.

European patent application EP 402 111 describes a process for the production of washing- and cleaning-active surfactant granules having a bulk density above 450 g/l and, more particularly, between 500 and 1200 g/l, in which a fine-particle solid is added to a surfactant preparation which contains water as its liquid component and which, in addition, may contain organic polymers and builders and the whole is subsequently granulated in a high-speed mixer. In this case, too, the water content of the surfactant paste is a critical process parameter. If the water content of the surfactant paste is too high, the solid is dispersed so that it can no longer act as a deagglomerating agent. If, on the other hand, the solids content exceeds a certain value, the preparation no longer has the consistency required for granulation.

Earlier hitherto unpublished patent application No. WO 93/04154 describes a process for the production of washing- and cleaning-active surfactant granules having an apparent density above 450 g/l by granulation of a surfactant preparation containing a non-surface-active liquid component, in which a surfactant preparation which is present in liquid to paste-like form under normal pressure at temperatures of 20° to 40° C. is granulated and at the same time dried, optionally with addition of an inorganic or organic solid. The granulation and simultaneous drying steps are preferably carried out in a fluidized bed (fluidized bed granulation). In addition to the surfactants, the surfactant preparation used also contains a non-surface-active liquid component which is preferably water or an aqueous solution. In this process, in contrast to the prior art mentioned above, the presence of a non-surface-active liquid component is not a critical process parameter. On the contrary, preparations containing anionic surfactants are normally produced by neutralization of the anionic surfactants in their acid form with concentrated aqueous alkaline solutions. However, to ensure that the preparation is present in liquid to paste-like form at temperatures of 20° to 40° C., the mixture generally has to be diluted with water. The high energy consumption required to remove the water must be regarded as a disadvantage.

The problem addressed by the present invention was further to develop the above-mentioned process of granulation and simultaneous drying to the extent that the energy consumption required for drying could be reduced.

DESCRIPTION OF THE INVENTION

Accordingly, the present invention relates to a process for the production of washing- and cleaning-active surfactant granules having a bulk density above 450 g/l by granulation of a surfactant preparation containing a non-surface-active liquid component, the surfactant preparation containing an anionic surfactant being prepared by separately treating the anionic surfactant in its acid form or a mixture containing one or more anionic surfactants in their acid form and an aqueous alkaline solution with a gaseous medium, subsequently spraying the anionic surfactant (mixture) and the aqueous alkaline solution in substantially stoichiometric quantities either separately or together into the granulation and drying zone under a high propellant gas pressure and carrying out the subsequent granulation step with simultaneous drying and, if desired, with addition of one or more inorganic or organic solids.

According to the invention, the anionic surfactant preparation may be produced either immediately after introduction of the individual reactant streams into the granulation or drying zone or beforehand. In the latter case, it is important to ensure that the distance between the point at which the gas-treated reactant streams are combined from the spray nozzle—although dependent on the process conditions and the material systems used—is preferably kept as small as possible to prevent blockage of the nozzle by neutralization reactions beginning too early. In one preferred embodiment of the invention, therefore, the anionic surfactant in its acid form or the mixture containing one or more anionic surfactants in their acid form is treated with a gaseous medium and sprayed into the granulation and drying zone through a multicomponent nozzle, for example through a two-component nozzle. Similarly, an aqueous alkaline solution is treated with a gaseous medium and sprayed simultaneously with the anionic surfactant in its acid form or with the mixture containing one or more anionic surfactants in their acid form into the granulation and drying zone in substantially stoichiometric quantities through another multicomponent nozzle. In this case, the neutralization and hence the production of the anionic surfactants takes place directly in the granulation and drying zone. In the context of the invention, the expression "substantially stoichiometric quantities" means that the ratio between the number of acidic groups to the number of alkaline groups is preferably in the range from 1.1:1 to 0.8:1 and more preferably in the range from 1:1 to 0.9:1.

In another and, in particular, preferred embodiment of the invention, however, the acidic and alkaline reactant streams separately treated with a gaseous medium are combined and sprayed into the granulation and drying zone through a single multicomponent nozzle, for example through a three-component nozzle. In this case, the neutralization process takes place for the most part in the nozzle or immediately after the nozzle. The combined acidic and alkaline reactant streams may of course also be sprayed into the granulation and drying zone through several multicomponent nozzles. This is particularly preferred when products are to be produced from various anionic surfactants, i.e. when various combined acidic and alkaline reactant streams are to be sprayed.

In the practical application of the process according to the invention, the starting materials are introduced in substantially stoichiometric quantities, for example using piston pumps, into one or two unmodified commercial nozzle(s) or into one or two spray tube(s). The gaseous medium (propellant gas) is introduced immediately before the nozzle. Where the combined reactant streams are sprayed, this means that the gaseous medium is introduced into the reactant streams before they are combined either in front of or inside the nozzle. Further technical particulars of the process, for example with regard to control of the reaction temperature, the flow rate of the reactant streams or the pressure under which the reaction mixture is sprayed into the granulation and drying zone, can be found in European patent application EP 319 819.

Suitable anionic surfactants in their acid form are carboxylic acids, sulfuric acid semiesters and sulfonic acids, preferably fatty acids, alkylaryl sulfonic acids, α-sulfofatty acid esters and the sulfuric acid semiesters of optionally alkoxylated, more particularly ethoxylated fatty alcohols and/or sulfosuccinic acid. In the broadest sense, fatty acid esters, more particularly fatty acid methyl esters, may also be used. In this case, there is no neutralization reaction, instead the ester group is saponified.

Accordingly, the anionic surfactants in their acid form may be selected in particular either from an anionic surfactant in its acid form or from a mixture from the group of anionic surfactants in their acid form, optionally in combination with nonionic, amphoteric and/or cationic surfactants. Preferred anionic surfactants in their acid form are $C_{8-22}$ alkyl sulfonic acids, $C_{9-13}$ alkyl benzenesulfonic acids (generally referred to as dodecyl benzenesulfonic acid) and α-sulfofatty acid methyl esters in their acid form. Particularly preferred alkyl sulfonic acids are the sulfuric acid monoesters of primary alcohols of natural and synthetic origin, more particularly the sulfuric acid monoesters of fatty alcohols, for example coconut oil fatty alcohols, tallow fatty alcohols, oleyl alcohol, lauryl alcohol, myristyl alcohol, palmityl alcohol or stearyl alcohol; or the $C_{10-20}$ oxoalcohols and sulfuric acid monoesters of secondary alcohols in the same chain length range. The sulfuric acid monoesters of alcohols ethoxylated with 1 to 6 moles of ethylene oxide, such as 2-methyl-branched $C_{9-11}$ alcohols containing on average 3.5 moles of ethylene oxide, are also suitable. Esters of α-sulfofatty acids (ester sulfonic acids) obtained by α-sulfonation of the methyl esters of fatty acids of vegetable and/or animal origin containing 10 to 20 carbon atoms in the fatty acid molecule, for example the α-sulfonated methyl esters of hydrogenated coconut oil, palm kernel oil or tallow fatty acids, and the α-sulfofatty acids (diacids) obtainable by ester cleavage are particularly suitable for use in the process according to the invention. The use of mixtures of the monoacids and diacids with other anionic surfactants in their acid form, for example with alkyl benzenesulfonic acids and/or fatty alkyl sulfonic acids, is also preferred.

Alkanesulfonic acids obtainable from $C_{12-18}$ alkanes by sulfochlorination or sulfoxidation are also suitable.

Preferred nonionic surfactants are derived from liquid alkoxylated, advantageously ethoxylated, more particularly primary, alcohols preferably containing 9 to 18 carbon atoms and on average 1 to 12 moles of ethylene oxide per mole of alcohol, in which the alcohol radical may be linear or methyl-branched in the 2-position or may contain linear and methyl-branched radicals in admixture, such as are typically present in oxoalcohol radicals. However, linear radicals of alcohols of native origin containing 12 to 18 carbon atoms, for example linear coconut oil, tallow or oleyl alcohol radicals, are particularly preferred. The degrees of ethoxylation shown are shown are statistical mean values which, for a specific product, may be a whole number or a broken number. Preferred alkoxylates have a narrow homolog distribution (so-called narrow-range ethoxylates, nre). Alcohol ethoxylates containing on average 2 to 8 ethylene oxide groups are particularly preferred. Preferred ethoxylated alcohols include, for example, $C_{9-11}$ oxoalcohol·7 EO, $C_{13-15}$ oxoalcohol ·3 EO, 5 EO or 7 EO and, in particular, $C_{12-14}$ alcohol ·3 EO or 4 EO, $C_{12-18}$ alcohols·3 EO, 5EO or 7 EO and mixtures thereof, such as mixtures of $C_{12-14}$ alcohol·3 EO and $C_{12-18}$ alcohol·5 EO. Other suitable nonionic surfactants are alkyl glycosides corresponding to the general formula R—O—$(G)_x$, in which R is a primary linear or 2-methyl-branched aliphatic radical containing 8 to 22 and preferably 12 to 18 carbon atoms, G is a symbol which stands for a glycose unit containing 5 or 6 carbon atoms and the degree of oligomerization x is between 1 and 10, preferably between 1 and 2 and, more preferably, well below 1.4.

The surfactant preparation may contain additives which are preferably ingredients of detergents and cleaning products as further constituents. More particularly, surfactant preparations containing additives in quantities of 0.001 to 15% by weight, based on the surfactant preparation, are used in the process according to the invention. Particularly preferred additives are dyes, foam inhibitors, bleaching agents and/or soluability-improving constituents.

Suitable dyes are heat-stable dyes, preferably pigments, which are advantageously used in quantities of 0.001 to 0.5% by weight, based on the surfactant preparation.

Suitable foam inhibitors are, for example, soaps of natural and synthetic origin which have a high percentage content of $C_{18-24}$ fatty acids. Suitable non-surfactant-active foam inhibitors are organopolysiloxanes and mixtures thereof with microfine, optionally silanized silica, paraffins, waxes, microcrystalline waxes and mixtures thereof with silanized silica or bis-stearyl ethylenediamide. Bis-acylamides derived from $C_{12-20}$ alkylamines and $C_{2-6}$ dicarboxylic acids are also suitable. Mixtures of different foam inhibitors, for example those of silicones and paraffins or waxes, may also be used with advantage. The foam inhibitors are preferably fixed to a granular water-soluble or water-dispersible support. The content of foam inhibitors in the surfactant preparation is preferably from 0.01 to 0.5% by weight.

Among the compounds yielding $H_2O_2$ in water which serve as bleaching agents, sodium perborate tetrahydrate and sodium perborate monohydrate are particularly important. Other suitable bleaching agents are, for example, peroxycarbonate, peroxypyrophosphates, citrate perhydrates, peroxophthalates, diperazelaic acid or diperdodecanedioic acid. In one particularly preferred embodiment, hydrogen peroxide is used as the bleaching agent in surfactant preparations used in accordance with the invention. The content of bleaching agent in the surfactant preparation is preferably from 0.5 to 15% by weight. More particularly, the hydrogen peroxide content is from 0.5 to 5% by weight.

The solubility-improving constituents include liquid, paste-like and solid compounds which are soluble or dispersible in the other constituents of the surfactant preparation. Preferred solubility-improving constituents are polyethylene glycols having a relative molecular weight of 200 to 20,000 and highly ethoxylated fatty alcohols containing 14 to 80 ethylene oxide groups per mole of alcohol, more particularly $C_{12-18}$ fatty alcohols containing 20 to 60 ethylene oxide groups, for example tallow fatty alcohol·30 EO or 40 EO. It is particularly preferred to use polyethylene glycols having a relative molecular weight of 200 to 600. These polyethylene glycols are advantageously used as a separate constituent of the non-surface-active liquid component. The content in the surfactant preparation of these constituents which improve the solubility of the granules is preferably from 1 to 15% by weight and more preferably from 2 to 10% by weight.

The neutralization or saponification reaction is preferably carried out with concentrated aqueous alkaline solutions, for example solutions of hydroxides, carbonates or hypochlorites of sodium or potassium, more particularly with a concentrated aqueous sodium hydroxide and/or potassium hydroxide solution, concentrations of 45 to 55% by weight being particularly preferred. There is no need for further dilution of the reactant streams with water, so that the process according to the invention has the advantage over the process described in earlier German patent application P 41 27 323.0 that the quantities of water to be removed in the granulation and drying zone are smaller, thus enabling energy consumption to be reduced.

Gases inert to the starting materials and end products, such as air or nitrogen, are particularly suitable for use as the gaseous medium (propellant gas). Steam is also suitable in principle, particularly if one of the reactant streams or all the reactant streams is/are to be heated before they are combined.

The sprayed reactant streams are then simultaneously granulated and dried. By "drying" is meant the partial or complete removal of the non-surface-active liquid component. If desired, residues of free water, i.e. non-bound water, and residues of alcohol may be present providing the final granules are free-flowing and non-tacky. However, a free water content of 10% by weight and more particularly, 0.1 to 7% by weight, based on the final granules, is preferably not exceeded.

As described in detail in earlier patent application WO 93/04154, the surfactant granules may be produced in any machines in which granulation and drying can be carried out simultaneously. Examples of such machines are heatable mixers and granulators, more particularly granulators of the Turbo Dryer® type (as manufactured by Vomm, Italy). In one preferred embodiment of the invention, however, the two process steps in question are carried out together in a fluidized bed operating in batches or continuously. In a particularly preferred embodiment, the process is carried out continuously in a fluidized bed. In this case, a constituent of the non-surface-active liquid component which was not incorporated in the surfactant preparation may be separately added at the same time. The nozzle or nozzles and the spraying direction of the products to be sprayed may be arranged in any way. Preferred fluidized bed arrangements have bottom plates with a diameter of at least 0.4 m. Fluidized bed arrangements with a bottom plate between 0.4 and 5 m in diameter, for example 1.5 m or 2.6 m in diameter, are particularly preferred. However, fluidized bed arrangements with a bottom plate larger than 5 m in diameter are also suitable. The bottom plate used is preferably a perforated bottom plate or a so-called Conidur plate (a commercial product of the Hein & Lehmann company, Federal Republic of Germany). The process according to the invention is preferably carried out at fluidizing air flow rates of 0.5 to 8 m/s and, more preferably, at fluidizing air flow rates of 1 to 5.5 m/s. The granules are advantageously discharged from the fluidized bed via a grading stage. Grading may be carried out, for example, in a sieve or by an air stream (grading air) flowing in countercurrent to the granules which is regulated in such a way that only particles beyond a certain size are removed from the fluidized bed, smaller particles being retained therein. Accordingly, the inflowing air is made up of the grading air and the bottom plate air, both of which may be heated or unheated or one of which may be heated and the other unheated. In exceptional cases, the bottom plate air may even be cooled. The temperature of the bottom plate air is generally in the range from −20° to 400° C., preferably in the range from 35° to 350° C. and more preferably in the range from 35° to 120° C. In one particularly preferred embodiment, the temperature of the fluidizing air approximately 5 cm above the bottom plate is 10° to 120° C., preferably 20° to 90° C. and more preferably 30° to 85° C. The air exit temperature is determined by the reaction conditions. In the preferred fluidized-bed process, a starting material serving as initial support for the surfactant preparation sprayed in must be present at the beginning of the process. Suitable starting materials are, above all, ingredients of detergents and cleaning products, more particularly those which may also be used as solids in the process according to the invention and which have a particle size distribution substantially corresponding to the particle size distribution of the final granules. In a particularly preferred embodiment, however, surfactant granules obtained in a previous run of the process are used as the starting material.

In the fluidized bed, the constituents of the non-surface-active liquid component undergo complete or partial evaporation, resulting in the formation of partly to fully dried "nuclei" which are coated with further quantities of the surfactant preparation introduced, granulated and again simultaneously dried.

In one particularly important embodiment, the surfactant preparation is granulated and simultaneously dried with addition of one or more inorganic or organic solids. The solid(s) in question may be pneumatically introduced through blow pipes. The solid, which acts as a support for the surfactant preparation, preferably consists of ingredients of detergents and cleaning products. The solid may even be selected, for example, from surfactants or surfactant mixtures which have been produced by granulation, by spray drying or by the process according to the invention and recycled. It is particularly preferred to use spray-dried surfactant granules and/or surfactant granules obtained by the process according to the invention. As an alternative to incorporation in the surfactant preparation, highly ethoxylated fatty alcohols, for example containing 20 to 80 EO and preferably 20 to 60 EO, more particularly tallow fatty alcohol containing 30 or 40 EO, may also be used with advantage as the solids.

In another preferred embodiment, the solids used are non-surface-active ingredients of detergents and cleaning products, preferably one or more constituents from the group consisting of alkali metal carbonates, alkali metal sulfates, crystalline and amorphous alkali metal silicates and layer silicates and also zeolite, more particularly detergent-range zeolite NaA, salts of citric acid or other polycarboxylic acids, solid peroxy bleaching agents and optionally bleach activators and solid polyethylene glycols having a relative molecular weight of 2,000 or higher, more particularly in the range from 4,000 to 20,000.

Preferred solids are fine-particle materials which are either directly produced or can be commercially obtained in this form or which can be converted into this fine-particle form by standard size reduction methods, for example by grinding in standard mills.

Preferred solids contain for example no more than 5% by weight of particles larger than 2 mm in diameter and preferably no more than 5% by weight of particles larger than 1.6 mm in diameter. Solids of which at least 90% by weight consist of particles smaller than 1.0 mm in diameter are particularly preferred. Examples of such solids are alkali metal carbonates containing more than 90% by weight of particles 0.5 mm or smaller in diameter and detergent-range zeolite NaA powder containing at least 90% by weight of particles smaller than 0.03 mm in diameter. In a particularly advantageous embodiment, the solids added are used in quantities of 10 to 50% by weight and, more particularly, in quantities of 20 to 45% by weight, based on the sum total of surfactant preparation and solid.

Another embodiment of the invention relates to the surfactant granules obtainable by the process according to the invention. Preferred surfactant granules contain from 10 to 100% by weight, more particularly from 30 to 95% by weight and, with particular advantage, from 40 to 90% by weight of surfactants, based on the final granules. Pure surfactant granules are obtained when the non-surface-active liquid component is completely evaporated so that the granules are completely dried and the solid optionally added consists of a pure surfactant material. In this case, surfactant granules which have been produced by the process according to the invention and which are now used as the solid in the process according to the invention are preferably optionally size-reduced to the required particle size distribution and recycled. The surfactant content of the granules may be adjusted to any of the required values.

The surfactant granules obtained by the process according to the invention preferably have a bulk density above 450 g/l to 1,000 g/l, more particularly in the range from 500 to 850 g/l, and are dust-free, i.e. they contain no particles smaller than 50 μm in size. The particle size distribution of the surfactant granules otherwise corresponds to the typical particle size distribution of a heavy prior-art detergent. More particularly, the surfactant granules have a particle size distribution in which at most 5% by weight and preferably at most 3% by weight of the particles have a diameter above 2.5 mm and at most 5% by weight and, with particular advantage, at most 3% by weight of the particles have a diameter below 0.1 mm. The surfactant granules are distinguished by their light color and by their good flow properties. No other measures have to be taken to prevent the surfactant granules produced in accordance with the invention from adhering to one another. If desired, however, the surfactant granules may be powdered in known manner with fine-particle materials, for example with zeolite NaA, soda, in another process step in order to increase their bulk density. Preferred surfactant granules have such a regular and, in particular, substantially spherical structure that there is generally no need and hence no preference for a spheronizing step.

EXAMPLES

In Examples 1 to 3, ABSS ($C_{12}$ alkyl benzenesulfonic acid; Example 1) and FASS (sulfuric acid semiester of $C_{12-14}$ fatty alcohol; Examples 2 and 3) were spray-neutralized with NaOH (50% by weight sodium hydroxide solution; propellant gas nitrogen) through a multicomponent nozzle and directly granulated together with a solid and at the same time dried in a combined granulator/dryer as manufactured by Glatt, Federal Republic of Germany. Surfactant granules which had been obtained in a previous run (under the same process conditions) and which had substantially the same composition as the final granules of Examples 1 to 3 were used as the starting material. The process conditions are shown in Table 1.

Soda (sodium carbonate with a bulk density of 620 g/l; a product of Matthes & Weber, Federal Republic of Germany) was used as the solid.

Example 4 describes the corresponding production of surfactant granules in the absence of solids.

Dust-free, non-tacky granules with high surfactant contents were obtained in every Example (see Table 2). In all the Examples, the percentage of granules larger than 2.5 mm in size was below 5% by weight.

TABLE 1

| Process parameters | Examples | | | |
|---|---|---|---|---|
| | 1 | 2 | 3 | 4 |
| Fluidized bed | | | | |
| - diameter in mm | 400 | 400 | 400 | 400 |
| - surface area in $m^2$ | 0.13 | 0.13 | 0.13 | 1.13 |
| Fluidizing air flow rate in m/s (under operating conditions without propellent gas) | 2.35 | 2.35 | 1.92 | 1.1 |
| Temperatures in °C. | | | | |
| - bottom plate air | 85 | 85 | 89 | 82 |
| - grading air | 20 | 20 | 10 | 20 |
| - fluidizing air approximately 5 cm above the bottom plate | 62 | 62 | 69 | 80 |
| - air exit | 60 | 60 | 60 | 76 |
| Throughput in kg/h | | | | |
| ABSS | 30 | — | — | — |
| FASS | — | 30 | 50 | 250 |
| NaOH | 7.5 | 7.1 | 12.9 | 59.1 |
| Soda | 50 | 40 | 40 | — |
| Starting material in kg | 20 | 20 | 20 | 120 |

TABLE 2

Characteristic data of the products

| | Examples | | | |
|---|---|---|---|---|
| | 1 | 2 | 3 | 4 |
| Surfactant content in % by weight | 39 | 45 | 53 | 92 |
| Water content in % by weight | <1 | <1 | 6 | 2.2 |
| Bulk density in g/l | 575 | 600 | 580 | 500 |
| Sieve analysis in % by weight | | | | |
| 2.5 mm | — | — | — | 1.8 |
| 1.6 mm | 6.8 | 2.5 | 23.4 | 7.0 |
| 0.8 mm | 32.8 | 28.6 | 34.9 | 36.3 |
| 0.6 mm | 21.2 | 25.3 | 14.5 | 26.1 |
| 0.4 mm | 21.8 | 24.7 | 12.7 | 19.9 |
| 0.2 mm | 15.5 | 12.6 | 11.0 | 8.1 |
| 0.1 mm | 1.9 | 6.3 | 3.5 | 0.8 |
| 0.05 mm | — | — | — | — |
| <0.05 mm | — | — | — | — |

Ad Example 4: The remainder of the granules (balance to 100%) consists of unsulfonated components and salts which were present in the raw material FASS.

Ad Examples 1–3: The remainder of the granules (balance to 100%) consists of soda and unsulfonated components and salts which were present in the raw materials ABSS and FASS.

We claim:

1. A process for producing surfactant granules having a bulk density of more than 450 g/l consisting of preparing a surfactant composition in its acid form containing a non-surface-active liquid component, preparing an aqueous alkaline solution, separately treating said surfactant composition and said aqueous alkaline solution with a gaseous medium, spraying said surfactant composition and said aqueous alkaline solution in substantially stoichiometric quantities either separately or simultaneously into a granulation and drying zone under a high propellant gas pressure, granulating and drying the mixture while optionally adding at least one solid to the mixture.

2. The process as in claim 1 wherein said surfactant composition and said aqueous alkaline solution are sprayed together into said granulation and drying zone through one or more multicomponent nozzles.

3. The process as in claim 1 wherein said surfactant composition is treated with a gaseous medium and sprayed into said granulation and drying zone through a multicomponent nozzle, while said aqueous alkaline solution is treated with a gaseous medium and simultaneously sprayed into said granulation and drying zone in substantially stoichiometric quantities through another multicomponent nozzle.

4. The process as in claim 1 wherein the ratio of the number of acidic groups of said surfactant composition to the number of alkaline groups of said alkaline solution is in the range of from 1.1:1 to 0.8:1.

5. The process as in claim 1 wherein said surfactant composition is selected from the group consisting of fatty acids, alkylaryl sulfonic acids, ∝-sulfofatty acid esters, and the sulfuric acid semiesters of optionally alkoxylated, fatty alcohols or sulfosuccinic acid.

6. The process as in claim 1 wherein said surfactant composition is selected from the group consisting of an anionic surfactant in its acid form or a mixture of anionic surfactants in their acid form in combination with a nonionic, amphoteric, or cationic surfactant.

7. The process as in claim 1 wherein said propellant gas is selected from the group consisting of air, nitrogen and steam.

8. The process as in claim 1 wherein the step of granulating and drying said mixture is carried out batchwise.

9. The process as in claim 1 wherein the step of granulating and drying said mixture is carried out continuously in a fluidized bed apparatus.

10. The process as in claim 9 wherein said granules are discharged from said fluidized bed apparatus via a grading stage.

11. The process as in claim 9 wherein the temperature of the bottom plate air of said fluidized bed apparatus in between −20° C. and 400° C., and the temperature of the fluidizing air about 5 cm above the bottom plate of said fluidized bed apparatus is between 10° C. and 120° C.

12. The process as in claim 1 wherein said solid is a non-surface-active ingredient of a detergent composition selected from the group consisting of alkali metal carbonates, alkali metal sulfates, crystalline and amorphous alkali metal silicates, layer silicates, zeolite, salts of citric acid and other polycarboxylic acids, solid peroxy bleaches, bleach activators, and solid polyethylene glycols having a molecular weight of at least 2,000.

13. The process as in claim 1 wherein said solid is present in a quantity of 10 to 50% by weight, based on the total weight of said surfactant granules and said solid.

14. The process as in claim 1 wherein said surfactant granules contain from 10 to 100% by weight of surfactant, based on the weight of said surfactant granules.

15. The process as in claim 14 wherein surfactant granules have a bulk density of more than 450 g/l to 1,000 g/l, and contain no particles smaller than 50 microns.

* * * * *